United States Patent [19]

Lemmo

[11] Patent Number: 4,655,120

[45] Date of Patent: Apr. 7, 1987

[54] DEFLECTOR SKIRT

[76] Inventor: Patrick V. Lemmo, 249-24 147th Rd., Rosedale, N.Y. 11422

[21] Appl. No.: 812,848

[22] Filed: Dec. 23, 1985

[51] Int. Cl.[4] ..... F24F 13/062

[52] U.S. Cl. ..... 98/40.05; 98/40.18; 98/40.19; 98/108; 98/114

[58] Field of Search ..... 98/40.01, 40.05, 40.13, 98/40.15, 40.18, 40.19, 101, 103, 108, 114

[56] References Cited

U.S. PATENT DOCUMENTS

| | | | |
|---|---|---|---|
| 456,520 | 7/1891 | Reese | 98/108 |
| 1,624,225 | 4/1927 | Elters | 98/108 |
| 2,468,858 | 5/1949 | Bahnson, Jr. | 98/40.19 |
| 2,719,476 | 10/1955 | Dovolis | 98/108 |
| 2,734,446 | 2/1956 | O'Day | 98/40.05 |

FOREIGN PATENT DOCUMENTS

| | | | |
|---|---|---|---|
| 537461 | 2/1957 | Canada | 98/40.05 |
| 61532 | 5/1981 | Japan | 98/40.18 |

OTHER PUBLICATIONS

*Flexiflo Engineering Manual* #34, "MPV Adjustable Pattern", Universal Diffuser Corp., Tuckahoe, N.Y., copyright 1957, p. 46.

*Primary Examiner*—Harold Joyce

*Attorney, Agent, or Firm*—Michael I. Kroll

[57] ABSTRACT

A deflector skirt is provided for an air duct that has an outlet port. The deflector skirt has four elongated deflector plates that when assembled together form a conical shape that will hang from a suspended ceiling to deflect exhausted air therefrom. In a modification the deflector skirt is mounted over an air duct in a wall to deflect the exhausted air therefrom.

2 Claims, 6 Drawing Figures

DEFLECTOR SKIRT

BACKGROUND OF THE INVENTION

1. Field of Invention

The instant invention relates generally to air distribution outlets and more specifically it relates to a deflector skirt for an outlet port of an air duct.

2. Description of the Prior Art

Numerous air distribution outlets have been provided in prior art that are adapted to release hot or cold air from an outlet port of an air duct into a room. While these prior art units may be suitable for the particular purpose to which they address, they would not be suitable for the purposes of the present invention as heretofore described.

SUMMARY OF THE INVENTION

A primary object of the present invention is to provide a deflector skirt that will overcome the shortcomings of the prior art devices.

Another object is to provide a deflector skirt that can be mounted to an outlet port of an air duct in a suspended ceiling or wall that will deflect the air outwardly therefrom.

An additional object is to provide a deflector skirt that can be assembled quickly without the use of special tools or equipment.

A further object is to provide a deflector skirt that is simple and easy to use.

A still further object is to provide a deflector skirt that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
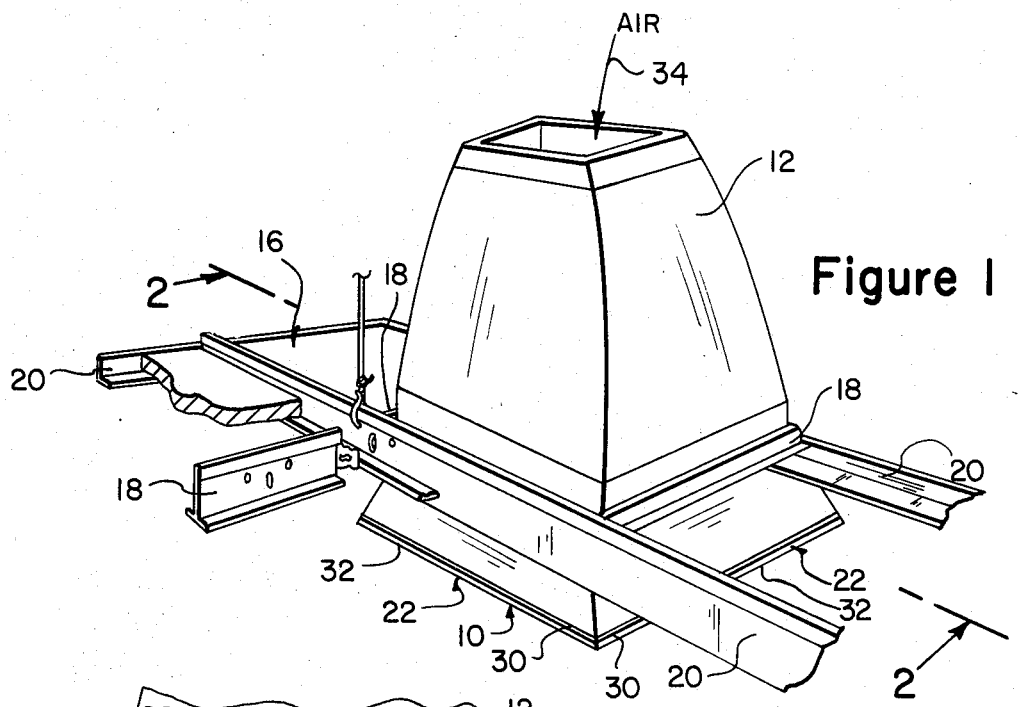
FIG. 1 is a perspective view with parts broken away of a suspended ceiling with the invention installed over an outlet port of an air duct therein.
Figure 2:
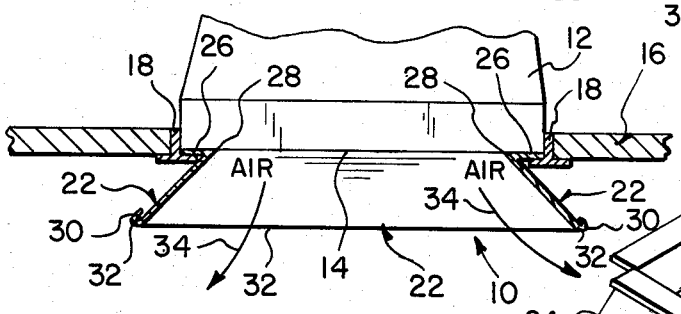
FIG. 2 is a cross sectional view taken along line 2—2 in FIG. 1.
Figure 3:
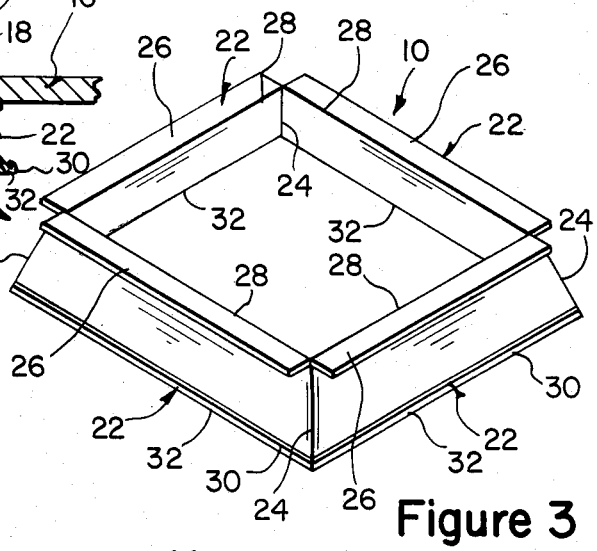
FIG. 3 is a perspective view of just the deflector skirt.
Figure 4:
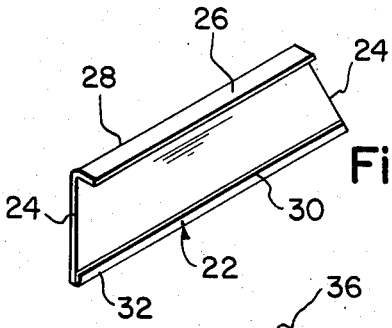
FIG. 4 is a perspective view of one of the deflector plates.

Turning now descriptively to the drawings, in which similar reference characters denote similar elements throughout the several views, FIGS. 1 through 4 illustrates a deflector skirt 10 for an air duct 12 that has an outlet port 14 which extends through a suspended ceiling 16 that has a plurality of cross tee members 18 and angle members 20. The deflector skirt 10 consists of four elongated deflector plates 22. Each of the plates has two angular short side ends 24, an outwardly extending flange 26 at top long end 28 and a bent edge 30 at bottom long end 32. When the deflector plates 22 are assembled together by welding or the like, the deflector skirt 10 will take on a conical shape. The top flanges 26 will hang from two of the cross tee members 18 and two of the angle members 20 allowing air 34 exhausted from the air duct 12 to be deflected away from the suspended ceiling 16.

Figure 5:
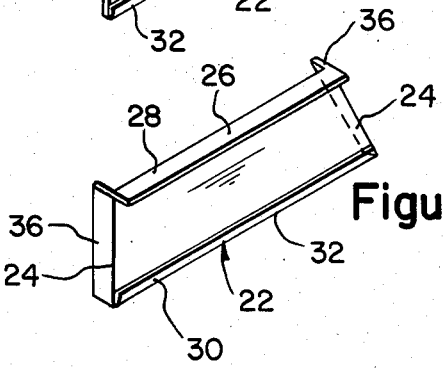
FIG. 5 is a perspective view similar to FIG. 4 of a modified deflector plate having a lip formed along each side edge thereof for easy installation.

FIG. 5 shows a modified deflector plate 22' that further includes a pair of lips 36. Each of the lips is formed on each of the two angular short side ends 24. All the deflector plates 22' can be assembled together quickly by overlapping the lips 36 without the use of special tools and equipment.

Figure 6:
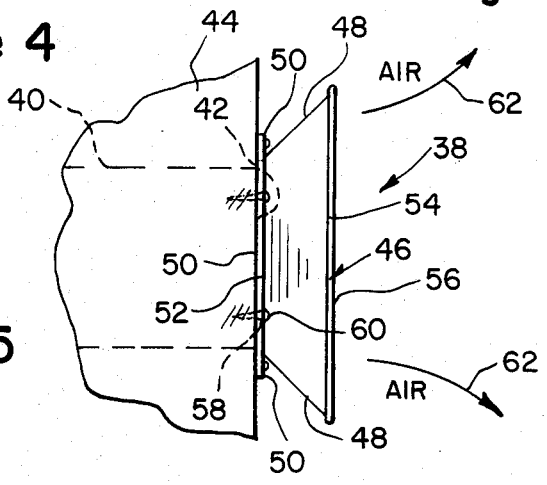
FIG. 6 is a side view of a modified deflector skirt mounted over an outlet port of an air duct in a wall.

FIG. 6 shows another type of deflector skirt 38 for an air duct 40 that has an outlet port 42 which extends through a wall 44. The deflector skirt 38 contains four elongated deflector plates 46. Each of the plates has two angular short side ends 48, an outwardly extending flange 50 at one long end 52, and a bent edge 54 at other long end 56. The flange 50 has a plurality of mounting holes 58 therein.

A plurality of fasteners 60 are provided. When the deflector plates 46 are assembled together by welding or the like the deflector skirt 38 will take on a conical shaped with the flanges 50 secured to the wall 44 by the fasteners 60 extending through the mounting holes 58 into the wall 44 allowing air 62 exhausted from the air duct 40 to be deflected away from the wall. Each of the fasteners 60 is a screw which will extend through one of the mounting holes 58 into the wall 44.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A deflector skirt for an air duct having an outlet port, said deflector skirt, when in use, being hanged from a suspended ceiling having a plurality of cross tee members and angle members, said deflector skirt comprising:

four elongated deflector plates, each of said deflector plates being substantially trapezoidal in shape so that each of said deflector plates has two angular short side ends, a top long end and a bottom long end;

four bent edges with one of said bent edges at said bottom long end of each of said four elongated deflector plates; and four outwardly extending flanges for hanging said deflector skirt from said suspended ceiling, with one of said outwardly extending flanges at said top long end of each of said four elongated deflector plates so that when said deflector plates are assembled together to form said deflector skirt, said assembly being carried out by connecting said angular short side ends of each of said deflector plates to said angular short ends of said deflector plates positioned adjacent thereto, said deflector skirt takes on a frustum-like shape with four trapezoidal-shaped sides, said deflector skirt to be hanged from said suspended ceiling with a first set being two of said outwardly extending flanges, positioned opposite to one another, resting on two of said cross tee members of said suspended ceiling and a second set being two of said outwardly extending flanges, positioned opposite to one another, resting on two of said angle members of said suspended ceiling thereby permitting said deflector skirt to hang from said suspended ceiling and allowing air exhausted from said air duct to be deflected away from said suspended ceiling.

2. A deflector skirt as recited in claim 1, wherein each of said deflector plates further includes a pair of lips, each formed on each of said two angular short side ends so that said deflector plates can be assembled together quickly by overlapping said lips without use of special tools and equipment.

* * * * *